US005937888A

United States Patent [19]

McKiernan et al.

[11] Patent Number: 5,937,888

[45] Date of Patent: Aug. 17, 1999

[54] TOILET WASTE COLLECTION SYSTEM FOR CAMPGROUNDS

[75] Inventors: Edward F. McKiernan, Wooster; James A. Sigler, Perrysville, both of Ohio

[73] Assignee: Sealand Technology, Inc., Big Prairie, Ohio

[21] Appl. No.: 08/996,876

[22] Filed: Dec. 23, 1997

[51] Int. Cl.[6] ..... F04F 3/00

[52] U.S. Cl. ..... 137/205; 4/431; 4/434; 137/899

[58] Field of Search ..... 4/431, 434, 441; 137/205, 614.19, 899

[56] References Cited

U.S. PATENT DOCUMENTS

| | | | |
|---|---|---|---|
| 4,184,506 | 1/1980 | Varis et al. | 4/431 X |
| 5,408,704 | 4/1995 | Bailey et al. . | |
| 5,621,924 | 4/1997 | Friedman et al. . | |
| 5,653,262 | 8/1997 | Hanemaayer | 137/899 |

FOREIGN PATENT DOCUMENTS

0312784 B1 4/1992 European Pat. Off. .

OTHER PUBLICATIONS

Nuhn Industries Ltd. "Vacuum Sewage Tanker" brochure, admitted prior art. (Undated).

VacuFlush System flyer, admitted prior art. (Undated).

*Primary Examiner*—Gerald A. Michalsky

*Attorney, Agent, or Firm*—Nixon & Vanderhye P.C.

[57] ABSTRACT

The unpleasant task of manually removing a sewage holding tank from a recreation vehicle at a campground, and emptying it, is avoided by operatively connecting the RV sewage system to a stationary (preferably underground) vacuum installation at the campground. While the RV is renting space at the campground it is connected to an above ground vacuum hookup (typically including a conduit and a shut-off valve, and usually also a flexible hose with a dripless free end connection), at a campsite. The hookup is, in turn, connected to at least one underground vacuum source. The vacuum source may be a vacuum pump connected to a number of vacuum tanks (one for each hookup), with a check valve (e. g. duckbill valve) isolating each vacuum tank from the others. Alternatively, the vacuum source may be a vacuum generator connected to each hookup, and a common gravity sewer pipe connected to all of the vacuum generators.

21 Claims, 6 Drawing Sheets

TOILET WASTE COLLECTION SYSTEM FOR CAMPGROUNDS

BACKGROUND AND SUMMARY OF THE INVENTION

Owners of conventional recreation vehicles ("RV's), also known as "caravans", which have toilets are typically faced with the unpleasant task of emptying sewage holding tanks often times on a daily basis. This chore can spoil or tarnish an otherwise wonderful camping experience. While the use of vacuum toilets can reduce the frequency of holding tank emptying since such toilets use little water, the basic problem still exists.

Some campgrounds utilize a mobile vacuum truck which travels from RV to RV, hooking up to the holding tank on the RV and sucking the contents into a storage tank on the truck. However this still requires the use of the holding tank while at the campground, which requires the users to add deodorant. Not only is the deodorant difficult to handle, and potentially toxic or irritating if it gets on the user's skin, the deodorant may interfere with on-site or municipal sewage treatment systems. Also the use of a vacuum truck requires significant labor costs for the campground.

Some campgrounds have individual campsite connections to a gravity drain system (rather than having a central dumping facility). However this also still requires the use of deodorant, and its associated disadvantages, and requires the use of large bore pipe and does not allow a construction that can follow the contour of the land. The hookup provided with the hose for a gravity feed system can be extremely messy unless a great deal of care is taken to make sure that the hose has a constant slope from the holding tank to the hookup for the gravity feed underground sewage system. If there are any low spots, sewage will collect in it, and dump out onto the ground, or at least present a significant odor problem, when the hose is disconnected or connected again.

It also has been known for some commercial housing installations to use a large central vacuum tank, which is designed to handle a certain number of toilets, and a formula is applied to size the tank based upon the number of toilets that are likely to be flushing at any one time. However such a system is impractical for the vast majority of campgrounds because it requires a large capital investment for the large pressure tank and associated pump, and because it does not allow individual units to be added without taking the risk that the system will be overloaded by too many toilets flushing at the same time.

According to the invention it is possible to eliminate the holding tank emptying problem at campgrounds. By providing vacuum installations at a campground it is possible to allow the user of an RV to make a connection between a hose and a toilet at a campground so that a holding tank is not even necessary (that is the toilet is substantially directly connected to the campground vacuum installation), or to connect from the holding tank to a vacuum source at the campground. Unlike conventional pump out stations which are common at marinas in which boats are merely connected to the station during actual sewage removal, the campground according to the invention provides constant attachment to the vacuum installation during substantially the entire time that the RV is renting space at the campground.

By the utilization of individual vacuum units/sources associated with each hookup (typically one hookup per campsite, or one hookup per two or three campsites), a number of advantages are achieved. First of all the system does not need the large capital expenditure of a single vacuum tank system, and allows the number of hook-ups to be expanded at will. Also the system according to the present invention can be above ground since the vacuum system can provide a lift of six to eight feet. Also the system is somewhat independent of gravity so that the system can be constructed to follow the contour of the land (even if underground), making it highly advantageous over convention gravity systems. Also the system can use small bore pipe (e.g. about 38 mm or about 1.5 inch, diameter) instead of large bore stand sewer pipe. Also according to one aspect of the invention existing gravity feed system campgrounds can easily be converted to vacuum systems, with the intended advantages.

According to one aspect of the invention, at a plurality of hook up points at a campground a vacuum source (above ground or underground) is provided. Extending upwardly at each hook up (e.g. campsite) at the campground is a conduit with a shut-off valve which can be connected to a hose, which in turn is connected to a part of the sewage system of an RV. Sewage from the RV sewage system is then drained directly into a (e.g. underground) sewage system at the campground. Each hook up point is isolated from the others so that flushing the toilet of one RV has no effect on the others.

According to another aspect of the invention, a campground is provided comprising: a (e.g. underground) sewage system at the campground; at least one (above ground or underground) vacuum source; and a plurality of vacuum hookups for the at least one vacuum source, each hook up constructed so that it can be connected to a sewage system on a recreation vehicle. The hookups are isolated from each other so that receipt of sewage from a recreation vehicle by one hookup does not significantly impact other recreation vehicles connected to other hookups, or to the same hookup.

The at least one vacuum source preferably comprises a stationary vacuum pump, and a vacuum tank connected to each hookup; the tanks and pump can be underground. A check valve (e.g. duckbill valve) is further preferably provided, connected between each of the vacuum tanks and the vacuum pump. Each of the hookups may comprise a conduit extending upwardly, above ground, and a shutoff valve in the conduit. The sewage system typically comprises an underground gravity sewer pipe connected to the vacuum pump. Alternatively, the vacuum source comprises an underground individual vacuum generator connected to each hookup, and the underground sewage system comprises a gravity sewer pipe connected to all of the vacuum generators. While preferably a hookup is provided for each campsite, a branched hookup can serve two or three adjacent campsites if appropriate check valves are provided in the branched connector of the hookup.

According to yet another object of the invention, a campground is provided comprising: a plurality of recreation vehicles parked at the campground, each recreation vehicle having an on-board sewage system, including a toilet (e.g. a vacuum toilet), with a discharge connection; a stationary sewage system; at least one stationary vacuum source; and a plurality of vacuum hookups for the at least one stationary vacuum source, each hook up operatively connected to the sewage system discharge on one of the parked recreation vehicles; the hookups being isolated from each other so that receipt of sewage from one of the plurality of recreation vehicles by one hookup does not significantly impact others of the plurality of recreation vehicles connected to other hookups or that hookup. The details of the campground may be as described above.

According to still another aspect of the present invention, a method of handling sewage from recreation vehicles having on board sewage systems with a toilet and a discharge connection, at a campground having at least one stationary sewage system, at least one stationary vacuum source, and a plurality of vacuum hookups for the at least one stationary vacuum source, is provided. The method comprises the steps of: (a) at the campground, parking a plurality of recreation vehicles adjacent the vacuum hookups, and operatively connecting each of a plurality of the recreation vehicle discharge connections to a plurality of the vacuum hookups; (b) maintaining the operative connections of each recreation vehicle to each vacuum hookup for a substantially continuous period of at least about eight hours [typically the entire time the RV is renting the campsite]; (c) when necessary, using and flushing the toilets in each of the recreation vehicles; and (d) when a toilet is flushed in a recreation vehicle, substantially immediately drawing the sewage from flushing into the stationary sewage system using the vacuum hookup to which the recreation vehicle discharge connection is operatively connected and using the at least one stationary vacuum source, while not significantly affecting the others of the plurality of recreation vehicles.

It is the primary object of the present invention to avoid the unpleasantness associated with the emptying of RV holding tanks at campgrounds, and the practical difficulties of present campground sewage systems. This and other objects of the invention will become clear from the detailed description of the invention, and from the appended claims.

DETAILED DESCRIPTION OF THE DRAWINGS

Figure 1:
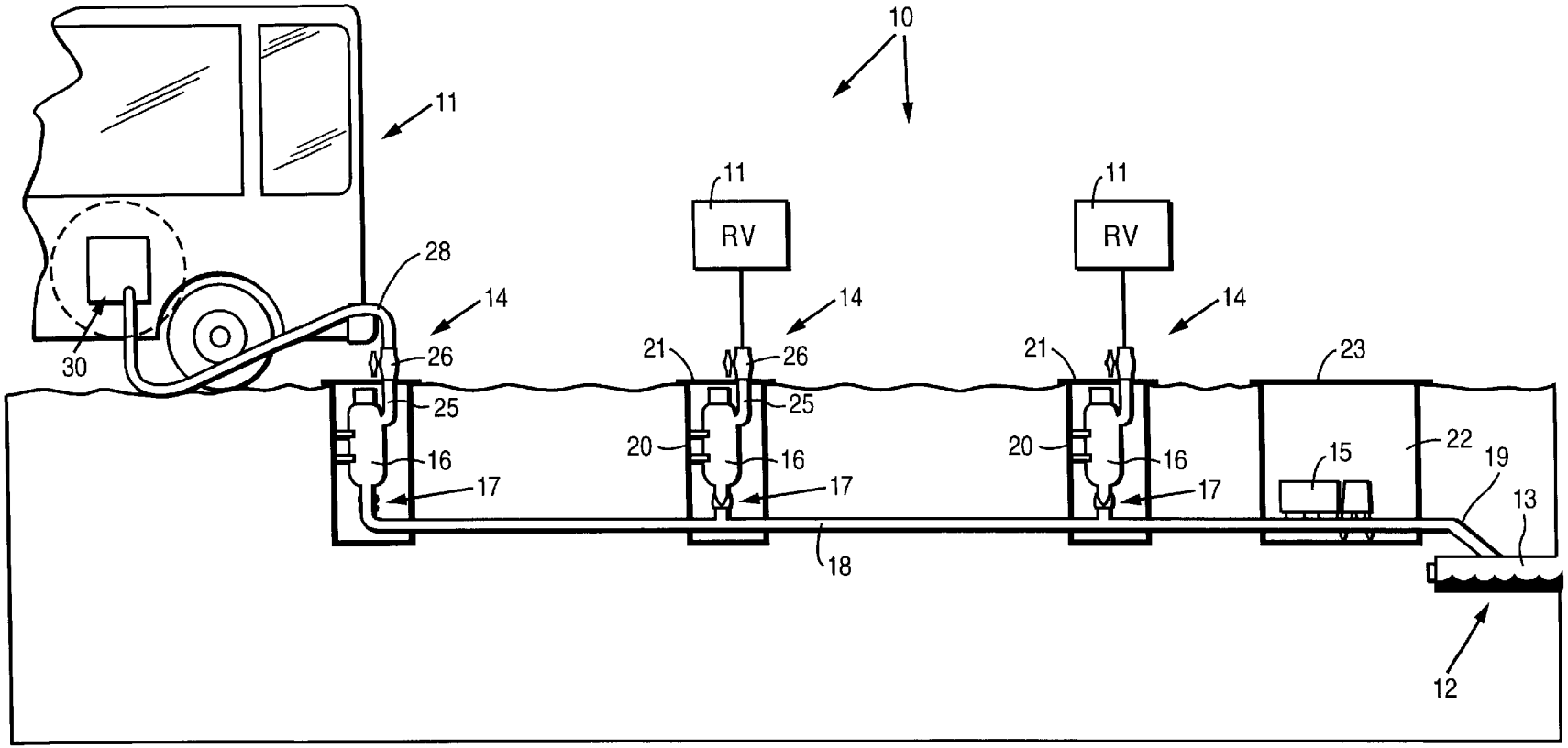
FIG. 1 is a schematic view of an exemplary campground with a vacuum installation and a recreation vehicle sewage system connected thereto, when the toilet on the RV is not flushing.

FIG. 1 schematically illustrates a campground, shown generally by reference numeral 10, according to the invention, for withdrawing sewage from a plurality of RVs, shown schematically by reference numerals 11, on an as-needed basis while the RVs are renting space at the campground 10. The RVs 11 typically will stay at the campground 10 about eight hours or more, often for several days or weeks. During substantially the entire time the RVs 11 are at the campground 10 they typically will be hooked up to the stationary sewage system—shown generally by reference numeral 12—at the campground 10.

Figure 3:
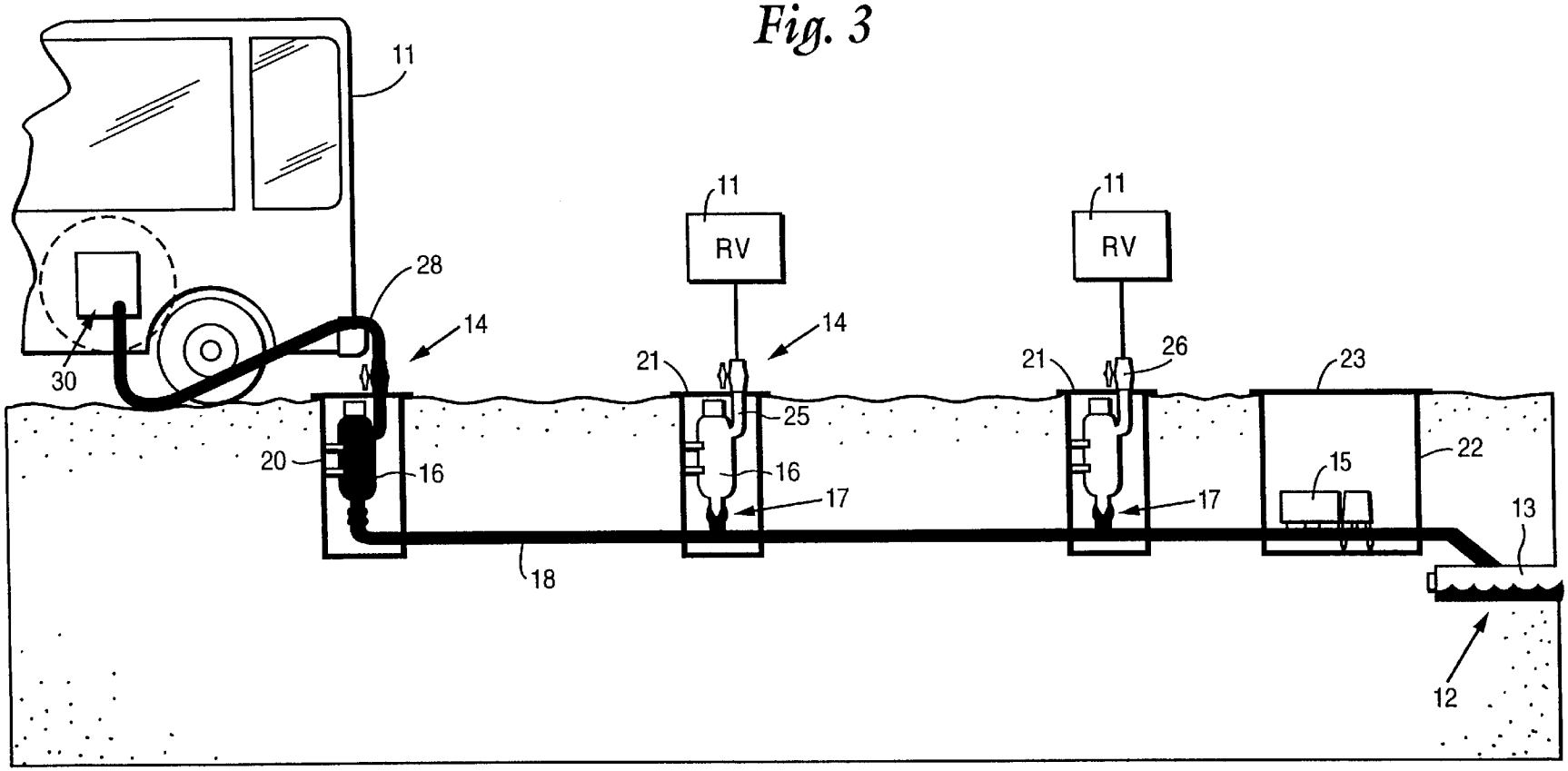
FIG. 3 is a view like that of FIG. 1 only showing the path of the sewage from the toilet on the RV as it is being flushed.

The sewage system 12 is desirably underground (although because a vacuum source is utilized according to the invention some or all components can be above ground if desired), as seen in FIGS. 1 and 3. System 12 typically includes a gravity sewer pipe 13 of conventional construction, which pipe 13 may be connected up to a main sewer line connected to a sewage treatment plant, a septic field, or the like. A plurality of vacuum hookups—each shown schematically at 14 in FIGS. 1 and 3—are connected to the sewage system 12 and at least one underground vacuum source. One hookup 14 may be provided for each campsite, or for two or three adjacent campsites. In the exemplary embodiment illustrated in FIGS. 1 and 3, the vacuum source comprises a conventional vacuum pump 15 common to a plurality of conventional vacuum tanks (also called vacuum reservoirs) 16.

The tanks 16 are isolated from each other so that the flushing of a toilet in one of the RVs 11 will not significantly affect (and certainly will not cause sewage backup to) the other RVs; that is the vacuum will be maintained in the other tanks 16 when one is receiving sewage from a flushed toilet, and essentially all toilets can be flushed at once, or in close proximity. This isolation is desirably effected by using a check valve 17 connected to each tank 16 isolating it from the other tanks 16. The check valve 17 may have a wide variety of constructions but preferably is a conventional duckbill valve, such as shown in U.S. Pat. No. 5,408,704, the vacuum in the tank 16 associated with the valve 17 helping to hold the valve 17 closed.

A conventional sensor, not shown, may be associated with one or more of the tanks 16 or the common line 18 connecting the tanks 16 to the pump 15 to control operation of the pump 15 as necessary. As is conventional per se (see U.S. Pat. Nos. 5,408,704 and 5,621,924), one or more check valves, not shown, are also preferably provided in the discharge line 19 from the pump 15 to the sewer pipe 13.

As seen in FIGS. 1 and 3, the tanks 16 are preferably disposed within hollow steel or plastic shells 20 which are substantially completely underground. Each shell has a top 21 which is preferably at about ground level, and the hookup 14 extends upwardly, above ground, from the tank 16. The pump 15 is in a similar shell 22, with its top 23 also at about ground level. Manholes, or other conventional mechanisms, may be provided to allow ready access to the pump 15 and tanks 16 for repair, service, replacement, or the like.

Each hookup 14 preferably comprises a conduit 25 (typically rigid) extending from a tank 16 through the shell top 21. A conventional manually (e.g. slide valve) or automatically (e.g. solenoid, from a central control at the campground 10 office) operated shut-off valve 26 is provided connected to conduit 25. If manually operated the valve 26 preferably is above ground level (above top 21 in FIGS. 1 and 3). Typically, a flexible (e.g. rubber) hose 28 is connected to the valve 26, by a conventional liquid-tight screw thread connection, bayonet connection, or the like (not shown), including conventional quick connects. The hose 28 may be carried by the RV 11, or provided by the campground 10 office once the RV user rents a hookup 14.

Figure 2:
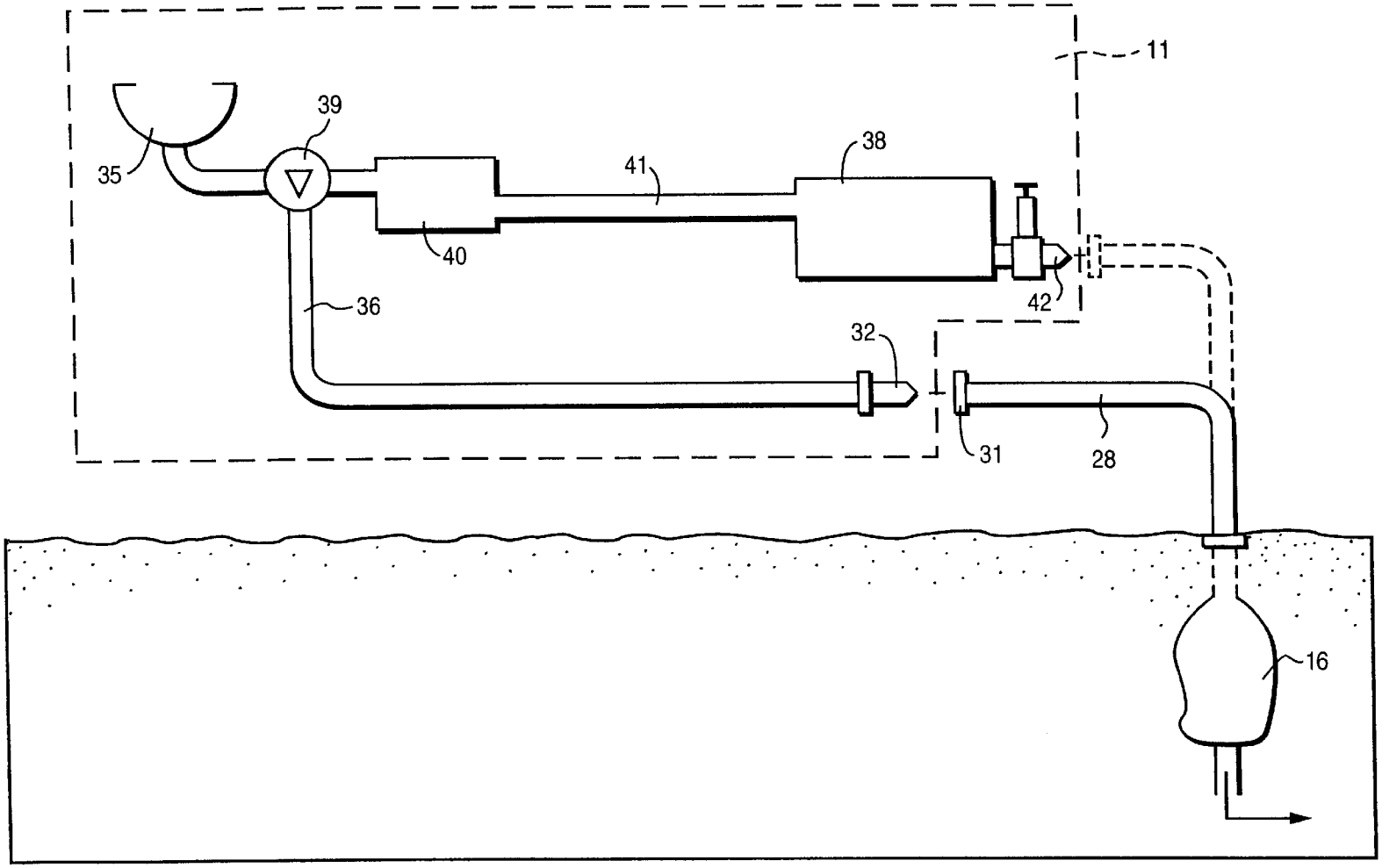
FIG. 2 is a schematic view of the RV on-board sewage system showing the dripless connectors or quick connector connecting it to the vacuum installation at the campground.

The free end of the hose 28 (that end opposite the valve 26) is connected up to the on-board sewage system—shown generally by reference numeral 30 in FIGS. 1–3—of the RV 11. Preferably the free end of the hose 28 has a dripless connection, shown schematically at 31 in FIG. 2. The dripless connection 31 cooperates with a matching dripless connection 32 associated with a discharge conduit 33 of the RV sewage system 30. The connections 31, 32 are shown only schematically in FIG. 2, but preferably are of the type shown in copending U.S. application Ser. No. 08/838,238, filed Apr. 17, 1997 (attorney docket 19-132), the disclosure of which is hereby incorporated by reference herein.

The on-board sewage system 30 includes a low water usage toilet 35, which may be of a wide variety of different conventional constructions. For example the toilet 35 may be a vacuum toilet such as a VACUFLUSH toilet available from Sealand Technology, or may be a gravity flush toilet. The hose 28 can be substantially directly connected to the toilet 35, as shown in FIG. 2. A conduit 36 has the dripless connection 32 attached thereto. Therefore when the toilet 35 is flushed, the sewage will be drawn—under the influence of the vacuum in the tank 16—directly (i.e. avoiding a holding tank) through the conduit 36, through the connections 31, 32, through the hose 28, and into the tank 16. From the tank 16 the sewage will flow to the pump 15, and then into sewer pipe 13. FIG. 3 shows the path of the sewage when the toilet 35 of the left-most RV 11 is flushed. As also seen in FIG. 3, the other tanks 16 are not affected when the toilet of the left-most RV 11 is flushed.

While it is most desirable that the toilet 35 be substantially directly connected to the stationary vacuum system at the campground 10, for use of the toilet 35 outside a campground a conventional holding tank 38 may be used. The tank 38 may be disconnected from the toilet 35 when the RV 11 is at the campground 10, or a valve 39 may be provided in the line 36 to optionally connect either the toilet 35 or the tank 38 to the hose 28. The sewage system 30 may also be of the type which contains its own vacuum pump and vacuum reservoir (e.g. vacuum generator 40) connected to the line 41 between the toilet 35 and the holding tank 38. The tank 38 may also have a dripless connection 42 connected thereto (for cooperation with the connection 31) if it is desirable to connect the tank 38 to the hose 28, rather than the conduit 36, and a slide valve 43 connected between tank 38 and connection 42.

Figure 4:
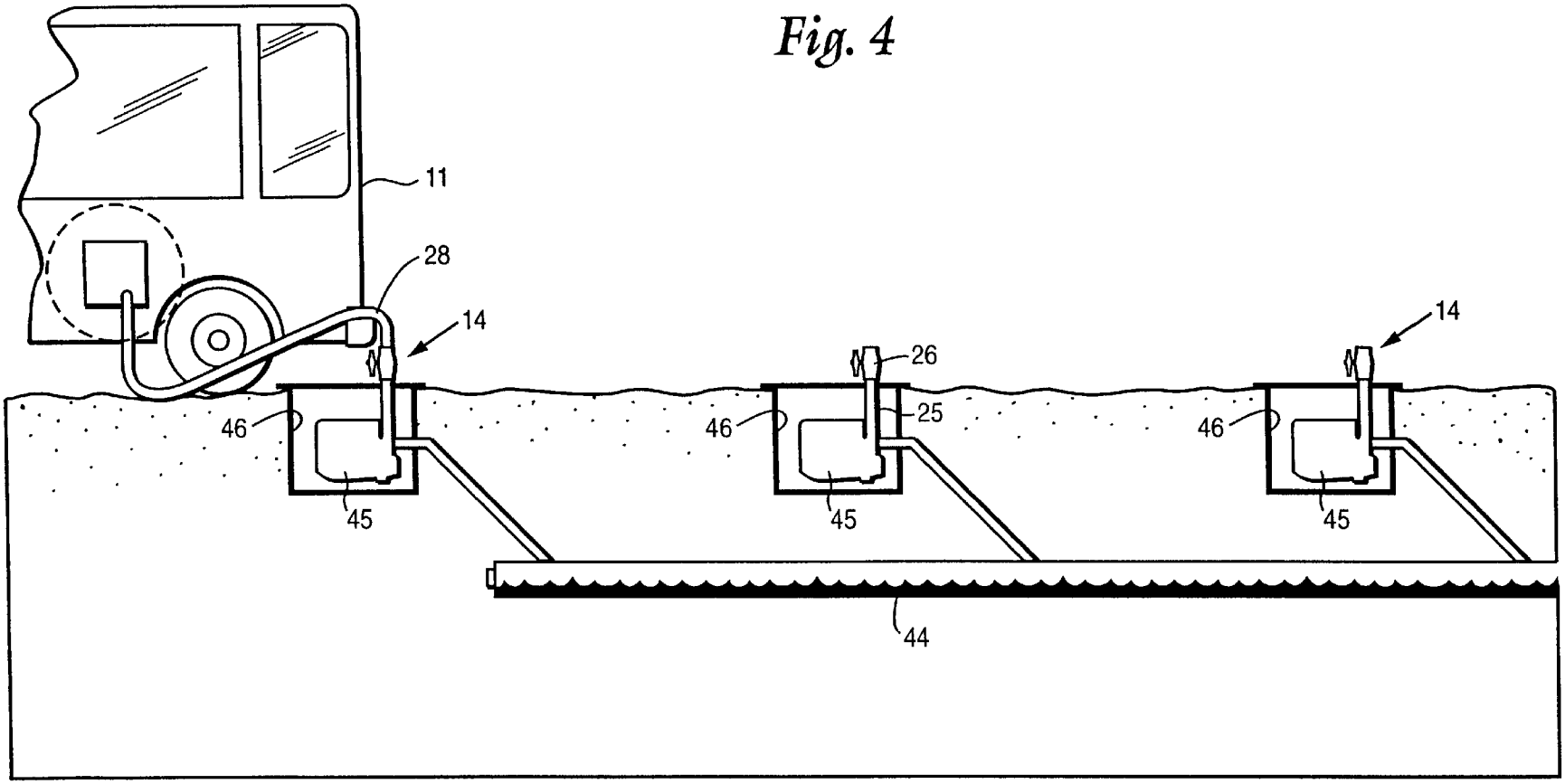
FIG. 4 is a view like that of FIG. 1 but of another exemplary embodiment of a campground vacuum installation, and RV, according to the invention.

FIG. 4 schematically illustrates another embodiment of the sewage system and vacuum source according to the present invention. In FIG. 4 structures that are the same as those in FIGS. 1–3 are shown by the same reference number. In this embodiment the sewage system comprises an underground sewer pipe 44 which extends close to each of the conventional vacuum generators 45. A vacuum generator 45 is associated with each of the hookups 14 is preferably underground in a shell 46. Each of the vacuum generators 45 discharges directly into the common sewer pipe 44, which is connected to another device or system, like the pipe 13 n FIGS. 1 and 3.

The vacuum generators 45 preferably are self-contained compact combinations of a vacuum pump and tank, such as shown in U.S. Pat. Nos. 5,621,924 and 5,408,704 (the disclosures of which are incorporated by reference herein). These units 45 need not be permanently installed at a campsite, but rather can be carried to the campsite when rented by the campground proprietor, and then installed, as will be described with respect to the FIG. 7 embodiment.

The embodiment of FIG. 4 allows ready retrofit of existing campgrounds with gravity flow sewage systems (e.g. pipes 44), so that such campgrounds may achieve the advantages of the invention.

Utilizing the equipment described above, a method of handling sewage from recreation vehicles 11 having on board sewage systems 30 with a toilet 35 and a discharge connection 32, at a campground 10 having at least one stationary sewage system 12, at least one stationary vacuum source, and a plurality of vacuum hookups 14 for the at least one stationary vacuum source is provided. The method comprises the steps of: (a) at the campground 10, parking a plurality of recreation vehicles 11 adjacent the vacuum hookups 14, and operatively connecting each of a plurality of the recreation vehicle discharge connections 32 to a plurality of the vacuum hookups 14; (b) maintaining the operative connections of each recreation vehicle 11 to each vacuum hookup 14 for a continuous period of at least about eight hours (often days or even weeks); (c) when necessary, using and flushing the toilets 35 in each of the recreation vehicles 11; and (d) when a toilet is flushed in a recreation vehicle, substantially immediately drawing the sewage from flushing into the stationary sewage system 12 using the vacuum hookup to which the recreation vehicle discharge connection is operatively connected and using the at least one stationary vacuum source (15, 16 or 45), while not significantly affecting the others of the plurality of recreation vehicles. Step (d) may be practiced—instead of substantially immediately—by connecting to a holding tank, and either manual or automatic periodic connection of the holding tank to the sewage system.

Where the at least one stationary vacuum source is a vacuum pump 15 and a plurality of vacuum tanks 16, one for each vacuum hookup 14, then step (d) may be practiced (in part) by isolating each vacuum tank 16 from the other vacuum tanks, e.g. using the check valves 17. Step (a) may be practiced for each recreation vehicle and vacuum hookup using a flexible hose 28 having a free end dripless connection 31 and connected to a vacuum hookup, which dripless hose connection 31 is connected to a dripless connection 32 connected substantially directly to the toilet 35.

If the at least one stationary vacuum source comprises a vacuum generator 45 associated with each vacuum hookup 14 and a gravity sewer pipe 44 connected to all the vacuum generators, then step (d) is practiced by drawing the sewage from the recreation vehicle toilet 35 to a vacuum generator 45, and discharging it from the vacuum generator to the gravity sewer pipe 44.

Figure 5:
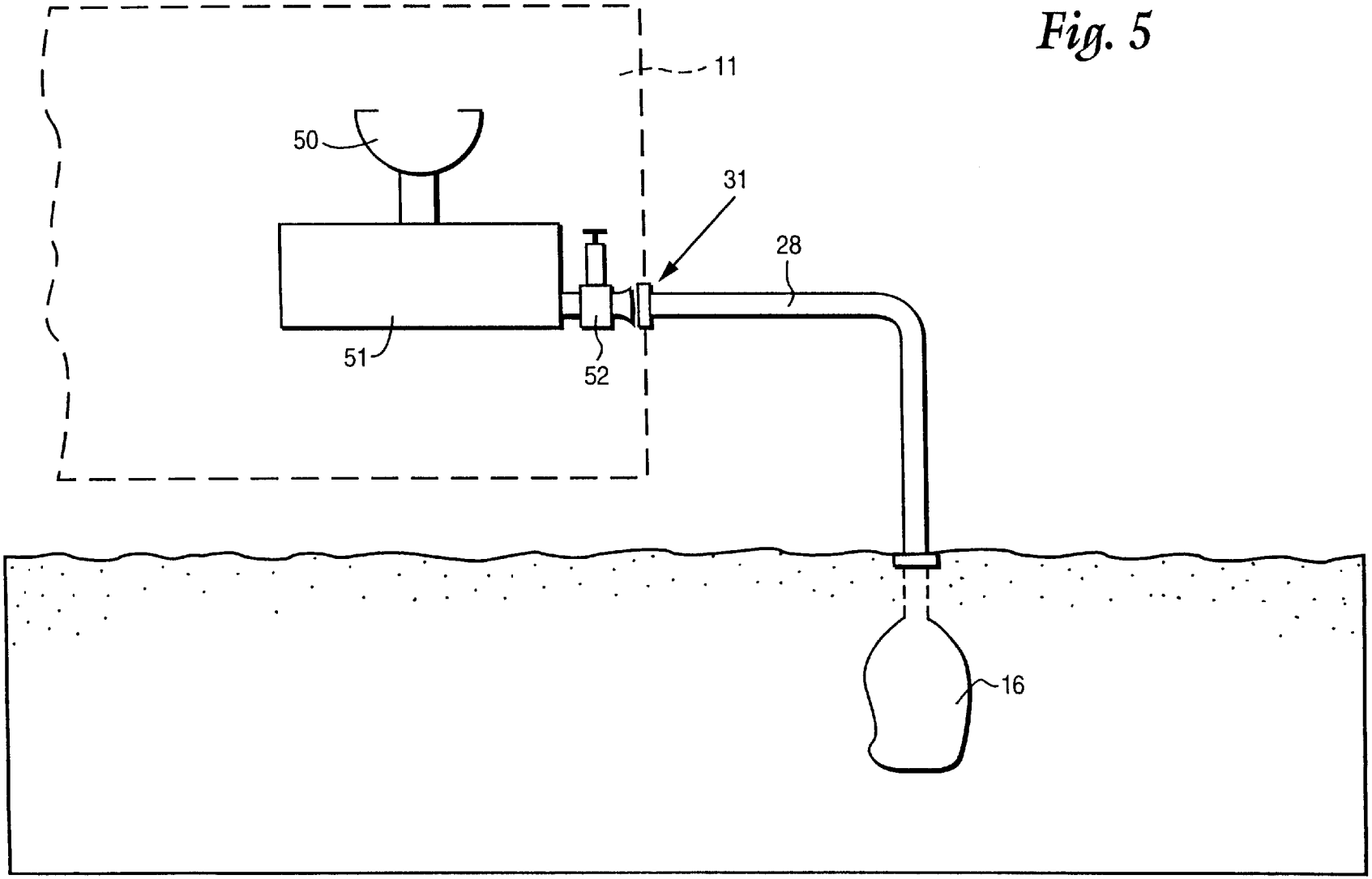
FIG. 5 is a view like that of FIG. 2 only showing an alternative system for connecting the campground hookup to the RV toilet.

FIG. 5 illustrates an embodiment where instead of a vacuum toilet (as in FIG. 2) a conventional gravity flush RV toilet 50, mounted above the fixed holding tank 51, is provided in RV 11. In this case the hose 28 connected to the vacuum system (such as vacuum reservoir 16) may be connected by a quick connect or a dripless connector 31 to a valve 52 for the holding tank. The valve 52 may be a conventional slide valve which is manually operated to connect the holding tank 51 to the vacuum tank 16, or the valve 52 may be automatically operated (e.g. periodically, or when a certain volume of sewage in the tank 51 is sensed) to provide such a connection.

Figure 6A:
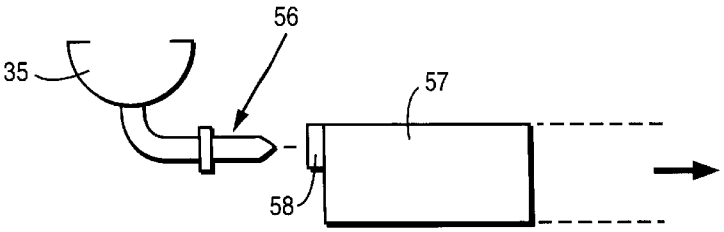
FIGS. 6*a* and 6*b* shows the disconnection of a removable vacuum holding tank and the connection to a campsite vacuum system, that may be utilized according to the invention.
Figure 6B:
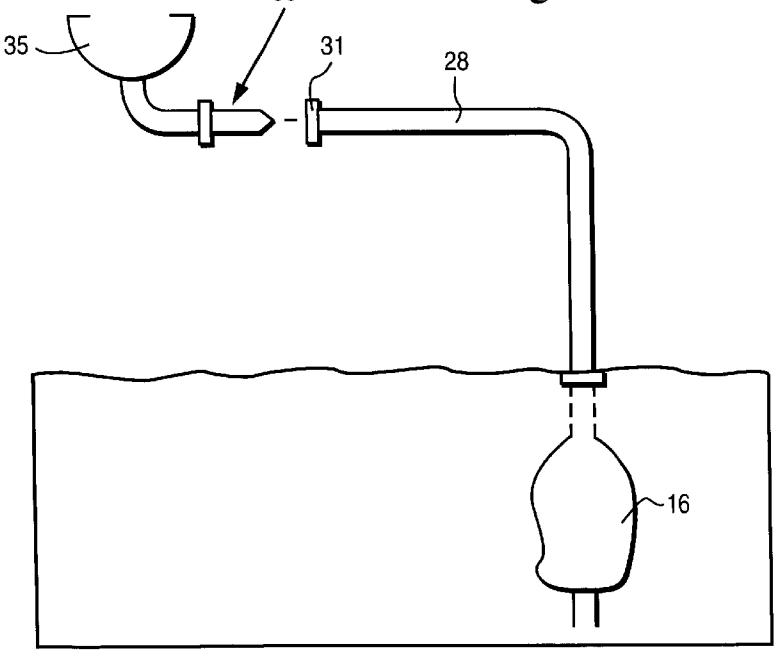

FIG. 6*a* shows a vacuum toilet 35 in an RV which has a no drip connector 56 which is connectable to a removable vacuum tank 57 (or a vacuum generator) also having a dripless connector 58. The vacuum unit 57 is readily removed when the RV driver gets to the campsite, and then—as illustrated in FIG. 6*b*—the no drip connector 56 is connected up to the no drip connector 31 on the hose 28 connected to the vacuum reservoir 16, or other vacuum system, at the campground 10.

Figure 7:
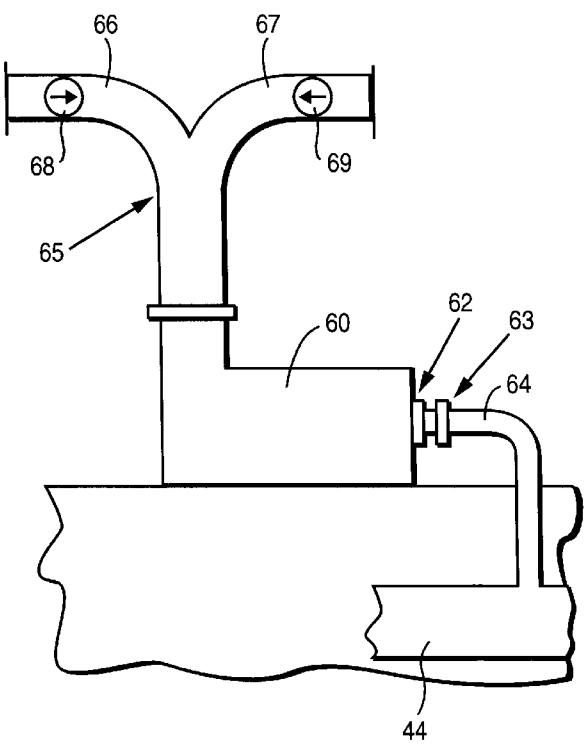
FIG. 7 shows another exemplary campsite hookup for a vacuum system that may be provided according to the invention as a modification of the FIG. 4 embodiment.

FIG. 7 schematically illustrates a situation where the hookup provided at a particular campsite can serve multiple RVs at adjacent campsites. Also in the embodiment illustrated in FIG. 7, an above ground vacuum source is illustrated, but it is to be understood that the multiple hookup can be utilized in the systems illustrated in FIGS. 1 and 3, and the above ground vacuum source can be utilized with single hookups.

In FIG. 7, a portable vacuum generator 60, similar to the vacuum generator 45 in the FIG. 4 embodiment, can be carried to a location where there is a permanent conduit hookup 61 connected to the gravity sewer pipe 44 of the campground. The connections 62, 63 between the vacuum generator 60 and the conduit 61 may be dripless connectors as earlier described. The vacuum generator 60 may also be connected to a source of electricity adjacent the conduit 61, or an extension cord can be run from the campground office.

To provide hookup to a plurality of RVs, the generator 60 comprises a branch conduit 65, having first and second branches 66, 67. More branches (e.g. a third branch) may also be provided if desired. Typically each branch has a check valve, such as shown schematically at 68, 69 in FIG. 7, therein, so that the RVs that are connected up to the branches 66, 67 are isolated from each other. The branches 66, 67 are connected up to individual RV sewage systems utilizing hoses 28 or the like as described in the other embodiments.

It will thus be seen that according to the invention a desirable method, and equipment, have been provided which avoid the unpleasantness and/or difficulties normally associated with emptying an RV holding tank. While the invention has been herein shown and described in what is presently considered to be the most preferred embodiment, it will be apparent to those of ordinary skill in the art that many modifications may be made thereof within the scope of the invention, which scope is to be accorded the broadest interpretation of the appended claims so as to encompass all equivalent methods and equipment.

What is claimed is:

1. A campground comprising:

a sewage system at the campground;

at least one vacuum source at the campground; and a plurality of vacuum hookups for said at least one vacuum source, each hook up constructed so that it can be connected to a sewage system on a recreation vehicle; said hookups being isolated from each other so that receipt of sewage from a recreation vehicle by one hookup does not significantly impact other recreation vehicles connected to other hookups.

2. A campground as recited in claim 1 wherein said at least one vacuum source comprises a vacuum pump, and a vacuum tank connected to each hookup and to said pump.

3. A campground as recited in claim 2 further comprising a check valve connected between each of said vacuum tanks and said vacuum pump.

4. A campground as recited in claim 3 wherein each of said check valves comprises a duckbill valve.

5. A campground as recited in claim 3 wherein said sewage system and vacuum source are underground, and wherein each of said hookups comprises a conduit extending upwardly, above ground, and a shutoff valve in said conduit.

6. A campground as recited in claim 5 wherein said underground sewage system comprises a gravity sewer pipe connected to said vacuum pump.

7. A campground as recited in claim 1 wherein said at least one vacuum source comprises an individual vacuum generator connected to each hookup, and wherein said sewage system comprises an underground gravity sewer pipe connected to all of the vacuum generators.

8. A campground as recited in claim 7 wherein each of said hookups comprises a conduit extending upwardly, above ground, and a shutoff valve in said conduit.

9. A campground as recited in claim 1 wherein each of said hookups comprises a conduit, and a shutoff valve in said conduit.

10. A campground as recited in claim 9 wherein each of said hookups further comprises a flexible hose connected to said shutoff valve and conduit at a first end thereof, and having a dripless connection for attachment to a recreation vehicle sewage system at a second end thereof opposite said first end.

11. A campground as recited in claim 10 wherein said at least one vacuum source comprises an individual vacuum generator connected to each hookup, and wherein said sewage system comprises an underground gravity sewer pipe connected to all of the vacuum generators.

12. A campground as recited in claim 10 wherein said at least one vacuum source comprises a vacuum pump, and a vacuum tank connected to each hookup and to said pump.

13. A campground as recited in claim 12 further comprising a check valve connected between each of said vacuum tanks and said vacuum pump.

14. A campground as recited in claim 12 wherein said sewage system and said vacuum pump are underground, and wherein said conduit of each of said hookups extends upwardly, above ground.

15. A campground comprising:

a plurality of recreation vehicles parked at said campground, each recreation vehicle having an on-board sewage system, including a toilet, with a discharge connection;

a stationary sewage system at said campground;

at least one stationary vacuum source at said campground; and a plurality of vacuum hookups for said at least one stationary vacuum source, each hook up operatively connected to said sewage system discharge on one of said parked recreation vehicles; said hookups being isolated from each other so that receipt of sewage from one of said plurality of recreation vehicles by one hookup does not significantly impact others of said plurality of recreation vehicles connected to other hookups.

16. A campground as recited in claim 15 wherein said on-board sewage system of each of said recreation vehicles discharges comprises a dripless connector or quick connector connected substantially directly to said toilet.

17. A campground as recited in claim 16 wherein each of said hookups comprises an above ground conduit and a shutoff valve in said conduit, and a flexible hose connected at a first end thereof to said shutoff valve and conduit, and having a dripless connector at a second end thereof connected to a said recreation vehicle dripless connector.

18. A campground as recited in claim 17 wherein said at least one stationary vacuum source comprises an individual vacuum generator connected to each hookup, and an underground gravity sewer pipe connected to all of the vacuum generators.

19. A campground as recited in claim 15 wherein said at least one stationary vacuum source comprises an underground vacuum pump, and a vacuum tank connected to each hookup and to said pump; and a check valve connected between each of said vacuum tanks and said vacuum pump.

20. A campground as recited in claim 19 wherein each of said vacuum tanks comprises an underground vacuum tank, and wherein said vacuum hookups extend above ground from each of said underground vacuum tanks.

21. A campground as recited in claim 15 wherein said at least one stationary vacuum source comprises an individual vacuum generator connected to each hookup, and an underground gravity sewer pipe connected to all of the vacuum generators.

* * * * *